US009719693B2

(12) United States Patent
Wu et al.

(10) Patent No.: US 9,719,693 B2
(45) Date of Patent: Aug. 1, 2017

(54) DEHUMIDIFIER

(71) Applicant: TCL AIR CONDITIONER (ZHONGSHAN) CO., LTD, Zhongshan, Guangdong (CN)

(72) Inventors: Xiongfeng Wu, Zhongshan (CN); Xianxiong Zhang, Zhongshan (CN)

(73) Assignee: TCL AIR CONDITIONER (ZHONGSHAN) CO., LTD, Zhongshan (CN)

( * ) Notice: Subject to any disclaimer, the term of this patent is extended or adjusted under 35 U.S.C. 154(b) by 382 days.

(21) Appl. No.: 14/587,006

(22) Filed: Dec. 31, 2014

(65) Prior Publication Data

US 2016/0061485 A1 Mar. 3, 2016

(30) Foreign Application Priority Data

Aug. 26, 2014 (CN) ..... 2014 2 0485545 U

(51) Int. Cl.

| | |
|---|---|
| ***F24F 3/14*** | (2006.01) |
| ***F24F 13/22*** | (2006.01) |
| ***F24F 13/20*** | (2006.01) |
| *F24F 6/00* | (2006.01) |

(52) U.S. Cl.

CPC ..... *F24F 13/222* (2013.01); *F24F 3/14* (2013.01); *F24F 13/20* (2013.01); *F24F 2003/144* (2013.01); *F24F 2006/008* (2013.01)

(58) Field of Classification Search

CPC ..... B01D 53/02; F24F 3/14
USPC ..... 96/143, 146
See application file for complete search history.

(56) References Cited

FOREIGN PATENT DOCUMENTS

| | | | | |
|---|---|---|---|---|
| JP | 06129666 A | * | 5/1994 | ..... F24F 3/153 |
| JP | 2001259352 A | * | 9/2001 | |

* cited by examiner

*Primary Examiner* — Robert A Hopkins

(57) ABSTRACT

The invention discloses a dehumidifier, including a chassis, a mainframe, a water receiving tank and a water tank, wherein the mainframe and the water tank are arranged on the chassis, and the water tank is detachably connected with the mainframe; the water receiving tank is arranged on the mainframe, and the drainage nozzle of the water receiving tank is over against the water receiving opening of the water tank. The dehumidifier further includes a water receiving container and a sliding bracket, wherein the water receiving container is arranged on the sliding bracket, the sliding bracket is in slide connection with the mainframe, and an elastic element is arranged between the sliding bracket and the mainframe. The problem that after the water tank is pulled out, the residual water flow drops onto the chassis through the drainage nozzle, is solved, thus the growth of bacteria on the chassis can be avoided.

10 Claims, 5 Drawing Sheets

DEHUMIDIFIER

CROSS-REFERENCE TO RELATED APPLICATIONS

This present application claims the benefit of Chinese Patent Application No. 201420485545.1 filed on Aug. 26, 2014, the contents of which are hereby incorporated by reference.

BACKGROUND

1. Technical Field

The present invention relates to the field of dehumidifier technology, and particularly, to a dehumidifier.

2. Description of Related Art

With the continuous improvement of living standards, people have increasingly higher requirements on the quality of life and also put forward a certain requirement on air humidity, and particularly in some special places, for example, an underground garage, due to perennial large humidity, articles in the garage are easy to rust, therefore, the humidity in the garage must be controlled.

At present, dehumidifier products specifically used for removing air humidity are put forward in the industry. This kind of dehumidifier products mainly includes a mainframe used for dehumidifying the air and a hand-held water tank used for storing water generated after dehumidification of the mainframe. The working manner is as follows: when the hand-held water tank is filled with water, the dehumidifier alarms to remind a user to pull out the water tank and pour water. However, when the user pulls out the water tank, even if the dehumidifier stops running, water in a heat exchanger and a water storage tank at the top of an intermediate partition board will drop downwards through a drainage nozzle, if not being received by other containers, the water flow will directly drop onto a chassis from the drainage nozzle, thus it is liable to grow bacteria on the chassis.

The above-mentioned contents are merely used for helping understand the technical solutions of the present invention, but it does not mean that the above-mentioned contents are acknowledged as the prior art.

SUMMARY

The main object of the present invention is to solve the technical problem that after a water tank of a dehumidifier is pulled out, residual water will drop onto a chassis.

To achieve the above object, the present invention provides a dehumidifier, including a chassis, a mainframe, a water receiving tank and a water tank, wherein the mainframe and the water tank are arranged on the chassis, and the water tank is detachably connected with the mainframe; the water receiving tank is arranged on the mainframe, and the drainage nozzle of the water receiving tank is over against the water receiving opening of the water tank;

the dehumidifier further includes a water receiving container and a sliding bracket, the water receiving container is arranged on the sliding bracket, the sliding bracket is in slide connection with the mainframe, and an elastic element is arranged between the sliding bracket and the mainframe; when the water tank is taken off from the dehumidifier, the sliding bracket is driven by the elastic element, in order to drive the water receiving container to move to a position below the drainage nozzle.

Preferably, the water receiving container includes a water storage tray and a water receiving tray extending from the top end of the water storage tray towards the outside of the water storage tray, and the water receiving tray is communicated with the water storage tray.

Preferably, a guide post is arranged on the mainframe, a shaft sleeve matched with the guide post is arranged on the sliding bracket, the shaft sleeve is sleeved on the guide post, the elastic element is a spiral spring, the elastic element is sleeved on the guide post, one end of the elastic element props against the mainframe, and the other end thereof props against the sliding bracket.

Preferably, the water receiving container is detachably connected with the sliding bracket.

Preferably, a slot for inserting the water receiving container is arranged on the sliding bracket.

Preferably, a first guide plate and a second guide plate are arranged on two opposite outer side walls of the water receiving container; the side wall of the slot is provided with a first limiting plate matched with the first guide plate, in a manner of corresponding to the first guide plate, and is provided with a second limiting plate matched with the second guide plate in a manner of corresponding to the second guide plate.

Preferably, an elastic buckle is arranged at the bottom of the slot, and a buckling position in buckling fit with the elastic buckle is arranged at a position corresponding to the elastic buckle on the water receiving container.

Preferably, a holding groove for holding the elastic buckle is arranged at a position corresponding to the elastic buckle, on the bottom of the slot.

Preferably, the elastic buckle includes an elastic cantilever arranged in the holding groove and a projection arranged on the elastic cantilever and stretching out from the holding groove.

Preferably, the projection is formed by bending the elastic cantilever towards one side of the water receiving container.

In the present invention, the water receiving container is arranged below the drainage nozzle of the water receiving tank, the water receiving container is fixed on the mainframe by the sliding bracket, and the elastic element for resetting is arranged between the sliding bracket and the mainframe; after the water tank is fixed, the water receiving container is pressure welded between the water tank and the mainframe, when the water tank is pulled out to pour water, the elastic element generates a thrust to enable the sliding bracket to drive the water receiving container to move to a position just below the drainage nozzle, in order to receive water flow flowing out from the drainage nozzle, thus avoiding the problem that the residual water flow drops onto the chassis through the drainage nozzle after the water tank is pulled out, and then the growth of bacteria on the chassis can be avoided.

The implementation of the objects, functional features and advantages of the present invention will be further illustrated with reference to accompanying drawings, in combination with the embodiments.

DETAILED DESCRIPTION

It should be understood that, the specific embodiments described herein are merely used for explaining the present invention, rather than limiting the present invention.

Figure 1:
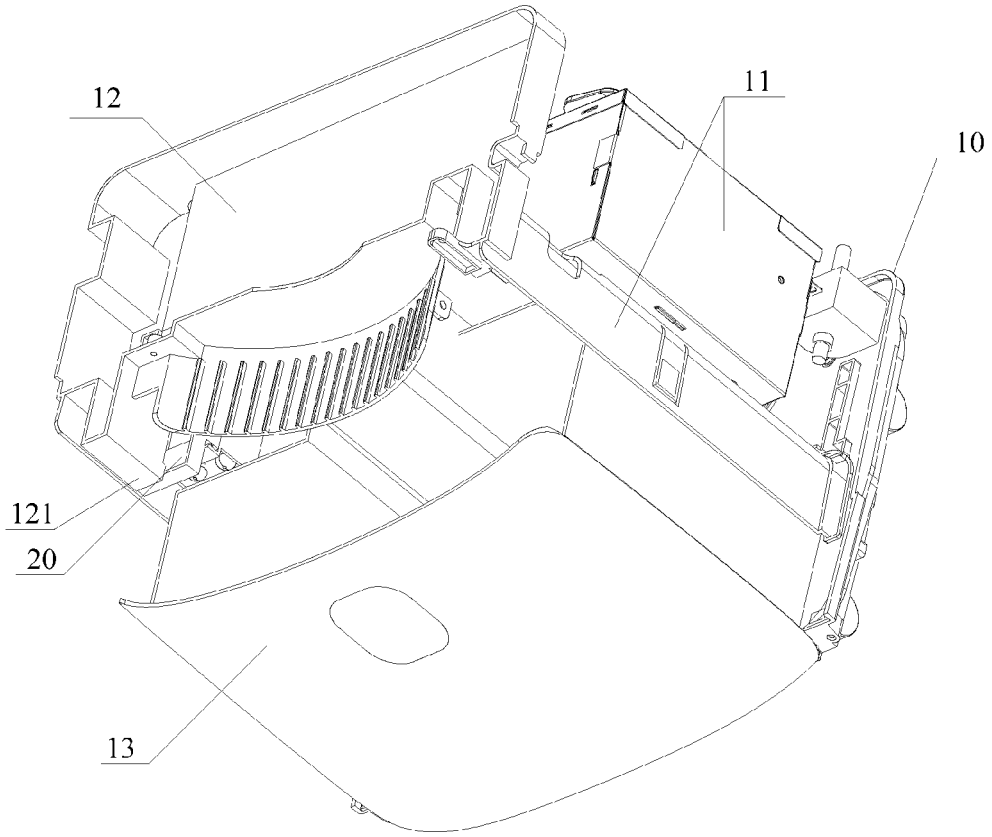
FIG. 1 is a schematic diagram of a structure of an embodiment of a dehumidifier in the present invention.
Figure 2:
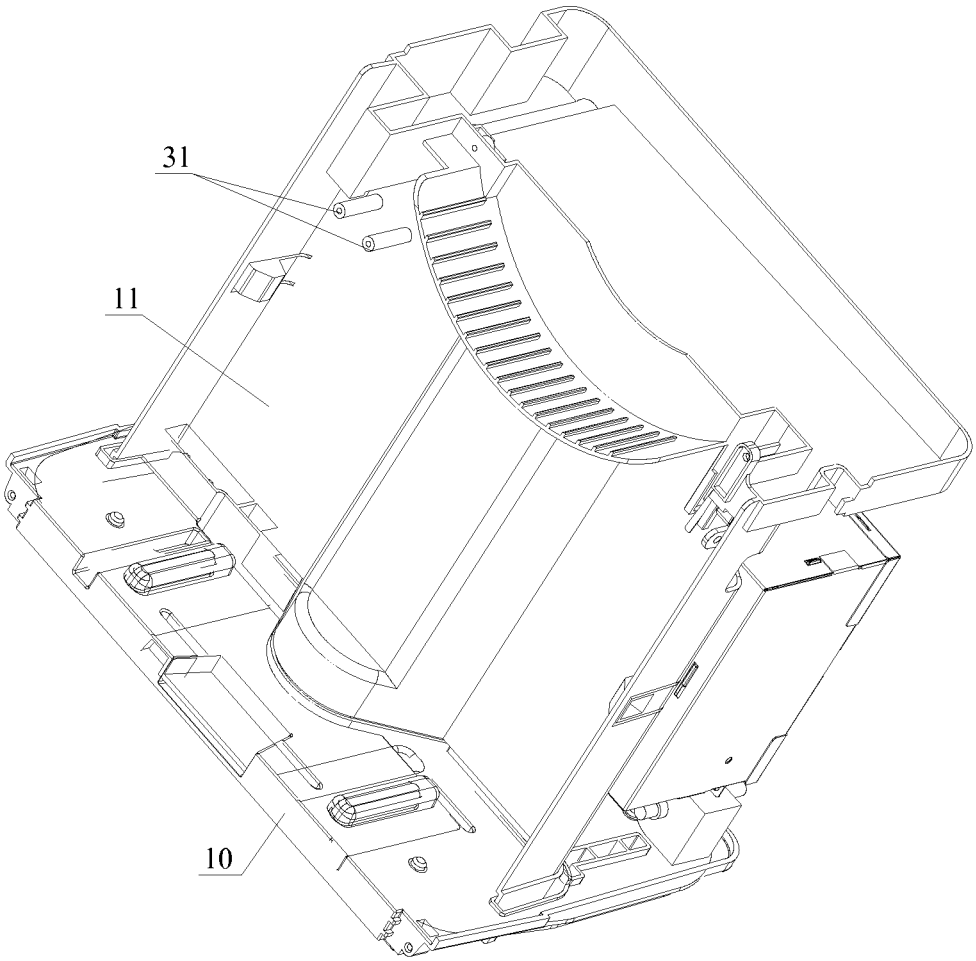
FIG. 2 is a partial schematic diagram of the structure of FIG. 1.
Figure 3:
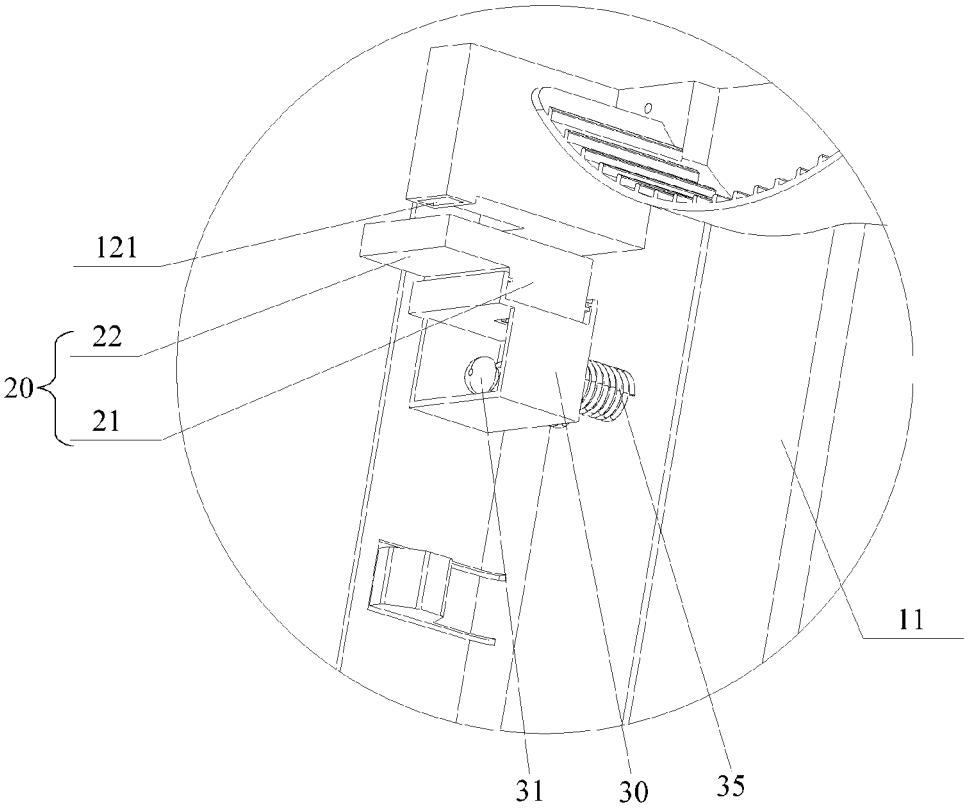
FIG. 3 is a schematic diagram of a structure that an assembled water receiving container, a mainframe and a water receiving tank are assembled in an embodiment of a dehumidifier in the present invention.

The present invention provides a dehumidifier, as shown in FIG. 1 to FIG. 3, in an embodiment, the dehumidifier includes a chassis 10, a mainframe 11, a water receiving tank 12 and a water tank 13, wherein the mainframe 11 and the water tank 13 are respectively arranged on the chassis 10, the water receiving tank 12 is arranged on the mainframe 11, the drainage nozzle 121 of the water receiving tank 12 is over against the water receiving opening of the water tank 13, the mainframe 11 is used for dehumidifying the air, and water flow generated after dehumidification is collected by the water receiving tank 12 and is drained into the water tank 13 through the water receiving tank 12 for storage. The water tank 13 is detachably connected with the mainframe 11, for conveniently taking off the water tank 13 when treating the water in the water tank 13.

In order to present the water in the water receiving tank 12 from flowing out from the drainage nozzle 121 to drop onto the chassis 10 when the water tank 13 is taken off, the dehumidifier further includes a water receiving container 20 and a sliding bracket 30, wherein the water receiving container 20 is arranged on the sliding bracket 30, the sliding bracket 30 is in slide connection with the mainframe 11, and an elastic element 35 is arranged between the sliding bracket 30 and the mainframe 11; when the water tank 13 is taken off from the dehumidifier, the sliding bracket 30 is driven by the elastic element 35 to drive the water receiving container 20 to move to a position below the drainage nozzle 121, in order to enable the water receiving container 20 to receive the water flow drained from the drainage nozzle 121, such that the problem that when the water tank 13 is taken off, the water flowing out from the drainage nozzle 121 directly drops onto the chassis 10, is solved.

Specifically, the above-mentioned mainframe 11 is mainly composed of a shell, an intermediate partition board, a compressor, an evaporator, a condenser, a blower and other components, and is used for dehumidifying the air, wherein the shell and the intermediate partition board define a holding cavity used for installing the compressor, the evaporator, the condenser and the blower. During installation, the mainframe 11 is firstly installed on the chassis 10, and then the water receiving tank 12 is installed on the mainframe 11, wherein after the water receiving tank 12 is installed, the drainage nozzle 121 is over against the chassis 10; then the water receiving container 20 is installed on the sliding bracket 30, and the sliding bracket 30 and the elastic element 35 are cooperatively installed on the mainframe 11, at this time, the water receiving container 20 and the sliding bracket 30 are located at a position just below the drainage nozzle 121 by means of the elastic element 35; then the water tank 13 is arranged on the chassis 10, at this time, the water tank 13 props against a part of the sliding bracket 30, the elastic element 35 is extruded towards the direction of the mainframe 11 via the sliding bracket 30, and the sliding bracket 30 drives the water receiving container 20 to depart from the position just below the drainage nozzle 121; finally, the water tank 13 is respectively connected with and fixed to the chassis 10 and the mainframe 11, for forming the dehumidifier through the chassis 10, the mainframe 11, the water receiving tank 12, the water receiving container 20, the sliding bracket 30, the elastic element 35 and the water tank 13.

It may be understood that, the volume of the above-mentioned water receiving container 20 is set according to the actual size of the dehumidifier, and is not limited herein. The water receiving container 20 may be connected with the sliding bracket 30 in a detachable connection manner, in order to conveniently take off the water receiving container to pour water after the water receiving container 20 is filled with water. The above-mentioned elastic element 35 may be implemented by an elastic component with large elastic resilience, such as a metal spring and an elastic piece, in order to reinforce the reliability of the elastic element 35.

In the present invention, the water receiving container 20 is arranged below the drainage nozzle 121 of the water receiving tank 12, the water receiving container 20 is fixed on the mainframe 11 by the sliding bracket 30, and the elastic element 35 for resetting is arranged between the sliding bracket 30 and the mainframe 11; after the water tank 13 is fixed, the water receiving container 20 is pressure welded between the water tank 13 and the mainframe 11, when the water tank 13 is pulled out to pour water, the elastic element 35 generates a thrust to enable the sliding bracket 30 to drive the water receiving container 20 to move to a position just below the drainage nozzle 121, in order to receive water flow flowing out from the drainage nozzle 121, thus avoiding the problem that the residual water flow drops onto the chassis 10 through the drainage nozzle 121 after the water tank 13 is pulled out, and then the growth of bacteria on the chassis 10 can be avoided.

Figure 6:
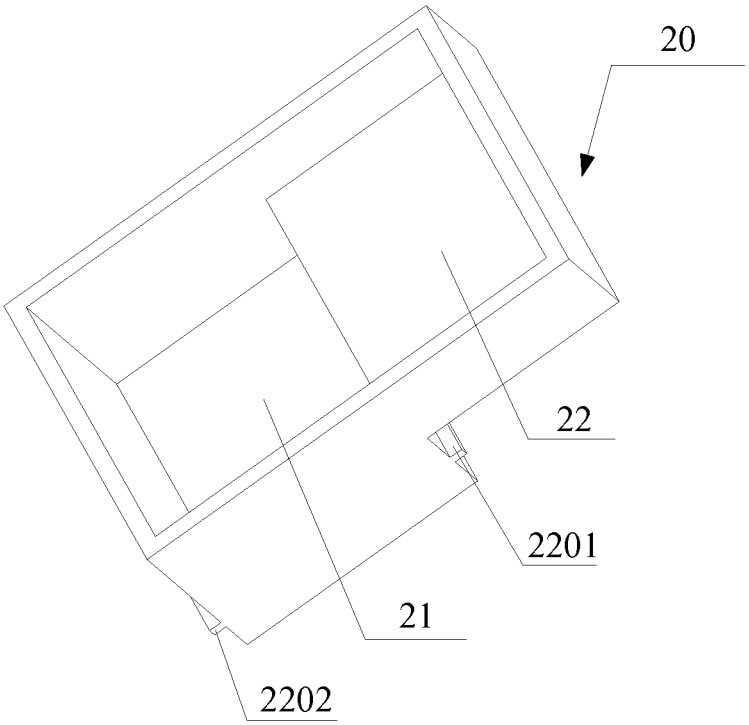
FIG. 6 is a schematic diagram of a structure of a water receiving container in an embodiment of a dehumidifier in the present invention.
Figure 7:
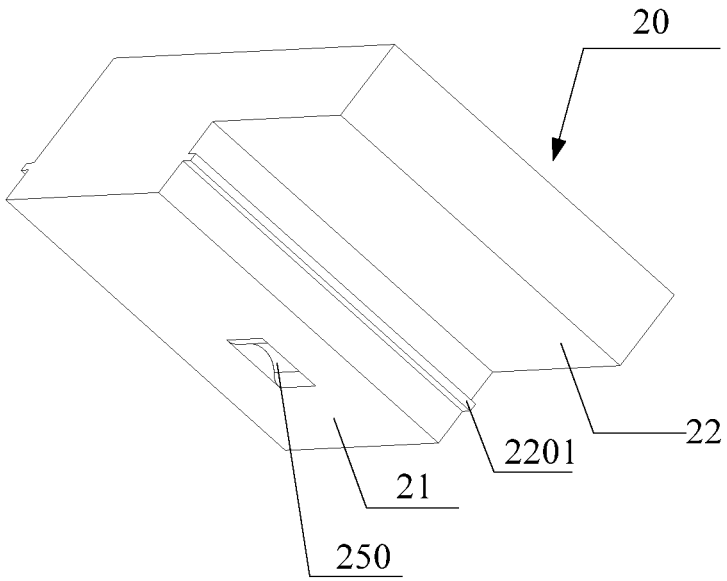
FIG. 7 is a schematic diagram of a structure at another visual angle of FIG. 6.

It may be understood that, the specific structure of the above-mentioned water receiving container 20 is not limited, and may be set according to actual demand. Furthermore, in combination with FIG. 6 and FIG. 7, to ensure the water receiving container 20 can conveniently receive the water flowing out from the drainage nozzle 121 when being popped up, the above-mentioned water receiving container 20 includes a water storage tray 21 and a water receiving tray 22 extending from the top end of the water storage tray 21 towards the outside of the water storage tray 21, and the water receiving tray 22 is communicated with the water storage tray 21. When the water tank 13 is taken off, the water receiving tray 22 moves to the position just below the drainage nozzle 121 to receive the water flow, and when the entire water receiving container 20 is detached, taking is convenient.

Further, specifically referring to FIG. 2 and FIG. 3, in the embodiment, a guide post 31 is arranged on the mainframe 11, a shaft sleeve matched with the guide post 31 is arranged on the sliding bracket 30, the shaft sleeve is sleeved on the guide post 31, the elastic element 35 is a spiral spring, the elastic element 35 is sleeved on the guide post 31, one end of the elastic element 35 props against the mainframe 11, and the other end thereof props against the sliding bracket 30.

In this case, the number of the guide posts 31 is not limited, and one or multiple guide posts may be arranged, when one guide post 31 is arranged, the guide post 31 needs to be arranged to a flat shape, for keeping the balance when the sliding bracket 30 is sleeved on the guide post 31; when multiple guide posts 31 are arranged, for example, two, the two guide posts 31 need to be arranged at left and right sides on the mainframe 11 at intervals, for keeping the balance when the sliding bracket 30 is sleeved on the guide posts 31. In the embodiment, two guide posts 31 are arranged, the guide posts 31 are cylindrical to facilitate sliding while ensuring the balance of the sliding bracket 30, wherein the elastic element 35 is arranged on each guide post 31, when the water tank 13 extrudes the sliding bracket 30, the elastic element 35 shrinks to drive the sliding bracket 30 to slide towards the direction of the mainframe 11 along the guide post 31, in order to ensure the water tank 13 to be installed in place, when the water tank 13 is pulled out, the elastic element 35 elastically expands to generate an elastic thrust to propel the sliding bracket 30 to slide to the position just below the drainage nozzle 121 along the guide post 31. In the preferable embodiment, the elastic element 35 is a metal spring.

Further, in order to conveniently detach the water receiving container 20 to facilitate pouring water, the water receiving container 20 is detachably connected with the sliding bracket 30. It may be understood that, the sliding bracket 30 may be of a groove structure, and the water receiving container 20 may be directly placed on the sliding bracket 30; or, a slot 210 for inserting the water receiving container 20 is arranged on the sliding bracket 30, and the water receiving container 20 may be pulled out from/inserted into the slot 210. Specifically, a first guide plate 2201 and a second guide plate 2202 are arranged on two opposite outer side walls of the water receiving container 20; the side wall of the slot 210 is provided with a first limiting plate 2101 matched with the first guide plate 2201 in a manner of corresponding to the first guide plate 2201, and is provided with a second limiting plate 2102 matched with the second guide plate 2202 in a manner of corresponding to the second guide plate 2202. The first limiting plate 2101 and the second limiting plate 2102 form a drawer type matching structure with the bottom of the slot 210 for enabling the water receiving container 20 to slide in or out, thereby not only ensuring the stability of the installed water receiving container 20, but also ensuring convenient extraction of the water receiving container when needing to be detached.

It may be understood that, for the convenience of manufacturing, the first limiting plate 2101 is corresponding to the second limiting plate 2102 in position.

Figure 4:
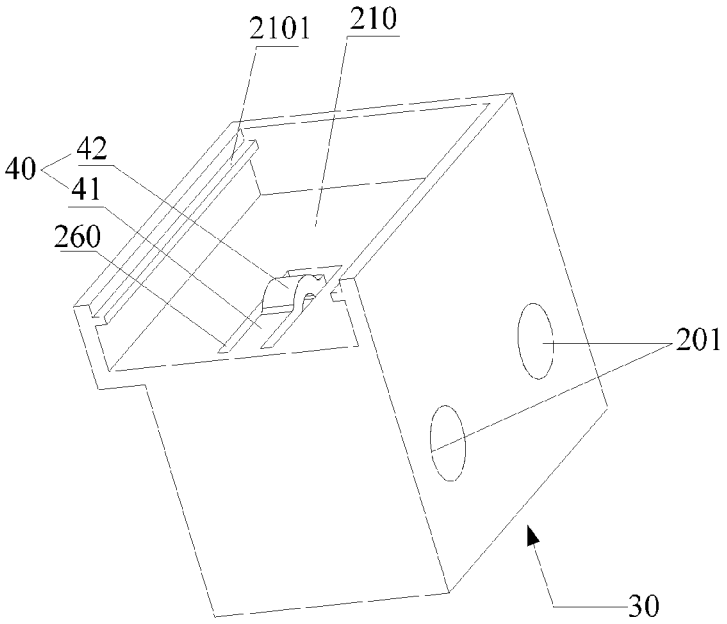
FIG. 4 is a schematic diagram of a structure of a sliding bracket in an embodiment of a dehumidifier in the present invention.
Figure 5:
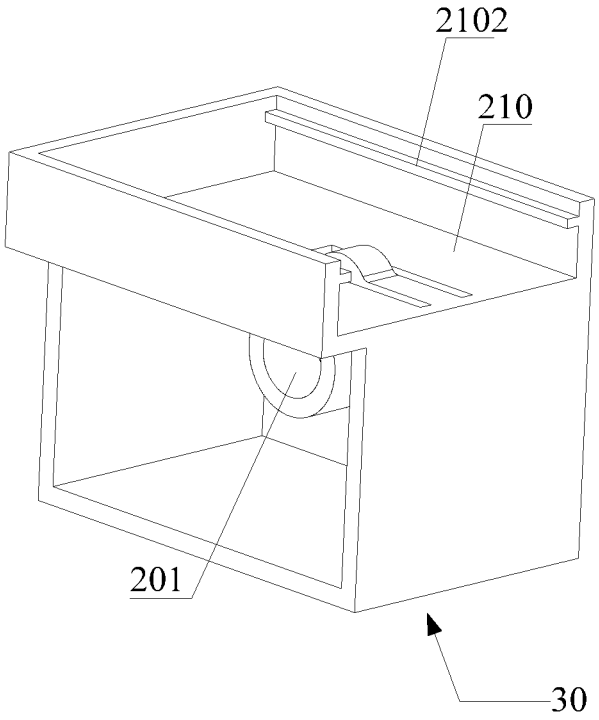
FIG. 5 is a schematic diagram of a structure at another visual angle of FIG. 4.

In addition, with reference to FIG. 4 and FIG. 5, an axle hole 201 in slide fit with the guide post 31 is arranged at a position corresponding to the guide post 31 on the bracket 21.

Further, in order to ensure that when being installed in the slot 210, the water receiving container 20 is unlikely to move, an elastic buckle 40 extending along the vertical direction of the bottom of the slot 210 is arranged at the bottom, and a buckling position 250 matched with the elastic buckle 40 is arranged at a position corresponding to the elastic buckle 40 on the water receiving container 20. It may be understood that, when the water receiving container 20 slides into the slot 210, the elastic buckle 40 is held in the buckling position 250, to limit the movement of the water receiving container 20. When the water receiving container 20 is pushed by a force, the elastic buckle 40 is stressed to deform to deviate from the buckling position 250, so that the water receiving container 20 can taken out from the slot 210.

Further, in order to ensure that the water receiving container 20 may be successfully pulled out from the slot 210, a holding groove 260 for holding the elastic buckle 40 is arranged at a position corresponding to the elastic buckle 40 at the bottom of the slot 210. When the water receiving container 20 is pulled out, the elastic buckle 40 is stressed to deform and evade towards the bottom of the slot 210, at this time, the elastic buckle 40 moves into the holding groove 260, to prevent the water receiving container 20 from being clamped by the elastic buckle 40 and prevent the elastic buckle 40 from being damaged by extrusion as well.

Specifically, the elastic buckle 40 includes an elastic cantilever 41 arranged in the holding groove 260 and a projection 42 stretching out from the holding groove 260, and the projection 42 enters in and leaves out the holding groove 260 via the elastic deformation of the elastic cantilever 41.

It may be understood that, the projection 42 may be directly arranged at the side opposite to the water receiving container 20 of the elastic cantilever 41, and may also be of an arched structure formed by partially bending the elastic cantilever 41 towards one side of the water receiving container 20. When being of the arched structure, the projection 42 has better elasticity and better coordination with the buckling position 250.

The foregoing descriptions are merely preferred embodiments of the present invention, but the patent scope of the present invention is not limited thereto. Any equivalent structures or equivalent flow variations made according to the description and accompanying drawings of the present invention, and direct or indirect applications in other related technical fields, are still encompassed in the patent protection scope of the present invention in the same way.

What is claimed is:

1. A dehumidifier, comprising a chassis, a mainframe, a water receiving tank and a water tank, wherein the mainframe and the water tank are arranged on the chassis, and the water tank is detachably connected with the mainframe; the water receiving tank is arranged on the mainframe, and a drainage nozzle of the water receiving tank is over against a water receiving opening of the water tank;

the dehumidifier further comprises a water receiving container and a sliding bracket, the water receiving container is arranged on the sliding bracket, the sliding bracket is in slide connection with the mainframe, and an elastic element is arranged between the sliding bracket and the mainframe; when the water tank is taken off from the dehumidifier, the sliding bracket is driven by the elastic element to drive the water receiving container to move to a position below the drainage nozzle.

2. The dehumidifier of claim 1, wherein the water receiving container comprises a water storage tray and a water receiving tray extending from the top end of the water storage tray towards an outside of the water storage tray, and the water receiving tray is communicated with the water storage tray.

3. The dehumidifier of claim 1, wherein a guide post is arranged on the mainframe, a shaft sleeve matched with the guide post is arranged on the sliding bracket, the shaft sleeve is sleeved on the guide post, the elastic element is a spiral spring, the elastic element is sleeved on the guide post, one end of the elastic element props against the mainframe, and the other end thereof props against the sliding bracket.

4. The dehumidifier of claim 1, wherein the water receiving container is detachably connected with the sliding bracket.

5. The dehumidifier of claim 4, wherein a slot for inserting the water receiving container is arranged on the sliding bracket.

6. The dehumidifier of claim 5, wherein a first guide plate and a second guide plate are arranged on two opposite outer side walls of the water receiving container; the side wall of the slot is provided with a first limiting plate matched with the first guide plate in a manner of corresponding to the first guide plate, and is provided with a second limiting plate matched with the second guide plate in a manner of corresponding to the second guide plate.

7. The dehumidifier of claim 6, wherein an elastic buckle is arranged at the bottom of the slot, and a buckling position in buckling fit with the elastic buckle is arranged at a position corresponding to the elastic buckle on the water receiving container.

8. The dehumidifier of claim 7, wherein a holding groove for holding the elastic buckle is arranged at a position corresponding to the elastic buckle on the bottom of the slot.

9. The dehumidifier of claim 8, wherein the elastic buckle comprises an elastic cantilever arranged in the holding groove and a projection arranged on the elastic cantilever and stretching out from the holding groove.

10. The dehumidifier of claim 9, wherein the projection is formed by bending the elastic cantilever towards one side of the water receiving container.

* * * * *